US006253057B1

(12) United States Patent
Yamanaka

(10) Patent No.: US 6,253,057 B1
(45) Date of Patent: Jun. 26, 2001

(54) SHEET PROCESSING APPARATUS WITH DIE COVER FORMED FROM ANTI-STATIC MATERIAL AND IMAGE FORMING PROCESS HAVING SAME

(75) Inventor: Yuji Yamanaka, Moriya-machi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/264,897

(22) Filed: Mar. 9, 1999

(30) Foreign Application Priority Data

Mar. 16, 1998 (JP) ..... 10-065882

(51) Int. Cl.[7] ..... G03G 15/00
(52) U.S. Cl. ..... 399/407; 270/58.07
(58) Field of Search ..... 399/403, 404, 399/405, 408, 407; 270/58.07, 58.09; 83/167, 687, 691, 405; 234/138

(56) References Cited

U.S. PATENT DOCUMENTS 5,290,020 * 3/1994 Matsui et al. ..... 270/58.07
5,746,162 * 5/1998 Hosoi et al. ..... 399/407

FOREIGN PATENT DOCUMENTS 56-33239 * 4/1981 (JP) .

* cited by examiner

*Primary Examiner*—Quana M. Grainger
(74) *Attorney, Agent, or Firm*—Fitzpatrick, Cella, Harper & Scinto

(57) ABSTRACT

A sheet processing apparatus includes a sheet convey path through which a sheet is conveyed, a punch and a die for perforating the sheet being conveyed through the sheet convey path, a cylindrical die cover having an opening at its one end and integrally formed with the die and formed from antistatic material, and a dust dropping hole through which punched pieces discharged from the opening of the die cover are dropped.

20 Claims, 10 Drawing Sheets

SHEET PROCESSING APPARATUS WITH DIE COVER FORMED FROM ANTI-STATIC MATERIAL AND IMAGE FORMING PROCESS HAVING SAME

BACKGROUND OF THE INVENTION

1. Field of the Invention

The present invention relates to a sheet processing apparatus, and more particularly, it relates to a sheet processing apparatus used with an image forming apparatus such as a copying machine and having a sheet punching device for perforating a sheet to be discharged, and an image forming apparatus having such a sheet processing apparatus.

2. Related Background Art

Conventionally, in some cases, a puncher for forming perforations in an end portion of a sheet (outputted from an image forming apparatus such as a printer, a copying machine and the like) to permit the sheets to be filed in a binder as a sheet bundle has additionally been used with a sheet processing apparatus.

Such a puncher serves to collectively form perforations in a sheet bundle including discharged sheets on which images were formed. In such a puncher, since the sheet bundle must be set in the puncher manually, workability is worsened. Further, if the sheet bundle includes a large number of sheets, a punch and a die of the puncher are subjected to great load, with the result that a greater force is required for perforating the sheet bundle and/or the punch and die are worn to generate poor punching and burrs in the perforations. To avoid this, if the sheet bundle includes a large number of sheets, the sheet bundle must be divided into sheet bundles each including a predetermined number of sheets or less and the divided sheet bundles must be perforated respectively, which results in further reduction of workability.

To cope with this, there has been proposed a sheet processing apparatus in which a puncher is provided in a sheet convey path and sheets stacked (as a sheet bundle) on a process tray in the apparatus are aligned and perforated collectively. With this arrangement, a conventional procedure for setting the sheet bundle in the puncher can be omitted, thereby enhancing the sheet processing ability.

However, in this apparatus, since the sheet bundle stacked on the process tray is perforated collectively, a next sheet cannot be conveyed while the sheet bundle is being perforated, with the result that it is difficult to increase a sheet conveying and processing speed of the image forming apparatus. Further, since the sheet bundle is perforated collectively, for every predetermined number of sheets, the perforating operation must be performed.

To solve this problem, there has been proposed a sheet processing apparatus in which a puncher comprising a rotatable punch and a rotatable die is provided in a sheet convey path, and a sheet conveying speed and a rotational speed of the puncher are synchronized. An example of such a puncher is shown in FIGS. 10A and 10B. In FIGS. 10A and 10B, a sheet (not shown) is conveyed through a sheet guide 13*a* of a puncher 13 from the above, and a rear end portion of the sheet is perforated by a punch 14 rotated in a direction shown by the arrow A and a die 15 rotated in a direction shown by the arrow B. Punch debris (punched pieces) PW produced in the punching operation is collected in a die cover 15*a* integrally formed with the die 15. As shown by the arrow a, the punched pieces PW are discharged into a puncher frame 25 through an opening 15*e* of the die cover 15*a* and are collected in a punch dust box (not shown) through a dust dropping hole 16 of the puncher frame 25. When the box is filled with the punched pieces PW, the punch dust box is removed from the image forming apparatus and the punched pieces PW are discarded.

With an arrangement as mentioned above, it is possible to perforate each sheet without stopping the conveyance of the sheet.

However, although a large amount of punched pieces PW discharged from the die cover 15*a* are dropped through the dust dropping hole 16, some of punched pieces PW are gradually accumulated in an area where the hole 16 does not exist, thereby sometimes closing the dust dropping hole 16.

Further, when the die cover 15*a* containing the punched pieces PW therein continues to rotate, the die cover 15*a* is electrically charged, with the result that the punched pieces PW are adhered to inner and outer peripheral surfaces of the die cover 15*a* to accumulate the punched pieces PW within the die cover 15*a* and the punched pieces PW adhered to the outer surface of the die cover 15*a* are scattered into the sheet guide 13*a*.

Further, when the sheet is punched by the punch die 15, the punched pieces PW may not be advanced inwardly of the die but are scattered outwardly of the die toward the sheet guide.

SUMMARY OF THE INVENTION

It is an object of the present invention to provide a sheet processing apparatus having a puncher, in which punched pieces discharged from a die cover into a punch dust box can be discharged from a dust dropping hole smoothly thereby to prevent the punched pieces from being accumulated within a puncher frame, and an image forming apparatus having such a sheet processing apparatus.

A sheet conveyed to the puncher through a sheet convey path is perforated by a punch and a die disposed within the puncher frame, and the punched pieces produced during the perforating operation and trapped within the die cover are discharged to a dust guide means through an opening of the die cover as the die cover is rotated and then are discharged out of the puncher frame while being guided by a partition plate and an inclined plate of the dust guide means. Thus, the punched pieces can be discharged from the puncher frame without inclining the puncher frame, thereby preventing the punched pieces from being accumulated within the puncher frame or from closing the dust dropping hole.

Further, by forming the die cover from antistatic material, the punched pieces can be prevented from being adhered to the die cover, thereby preventing the punched pieces from being accumulated within the die cover and from scattering into the sheet guide due to adhesion of the punched pieces to the outer surface of the die cover.

Further, the produced punched pieces are collected in the die cover and are discharged from the opening along a tapered portion of the die cover. Since the punched pieces in the die cover are discharged positively, the punched pieces can be prevented from being accumulated within the die cover.

Further, by providing a boss on the punch, during the punching operation, the punched pieces are pushed inwardly of the die by the boss, thereby preventing the punched pieces from scattering outwardly of the die.

Further, when a punch job is continuously effected for the sheets, under the action of a centrifugal force generated by the rotation of the die, the punched pieces may be adhered to the inner surface of the die. However, after the punch job was finished or immediately before the punch job is started, by rotating the die through a predetermined angle at a low speed and then rotating it in a reverse direction through a predetermined angle, the punched pieces can be dropped within the die cover.

DESCRIPTION OF THE PREFERRED EMBODIMENTS

The present invention will be now explained in connection with an embodiment thereof with reference to the accompanying drawings.

<Image Forming Apparatus>

Figure 1:
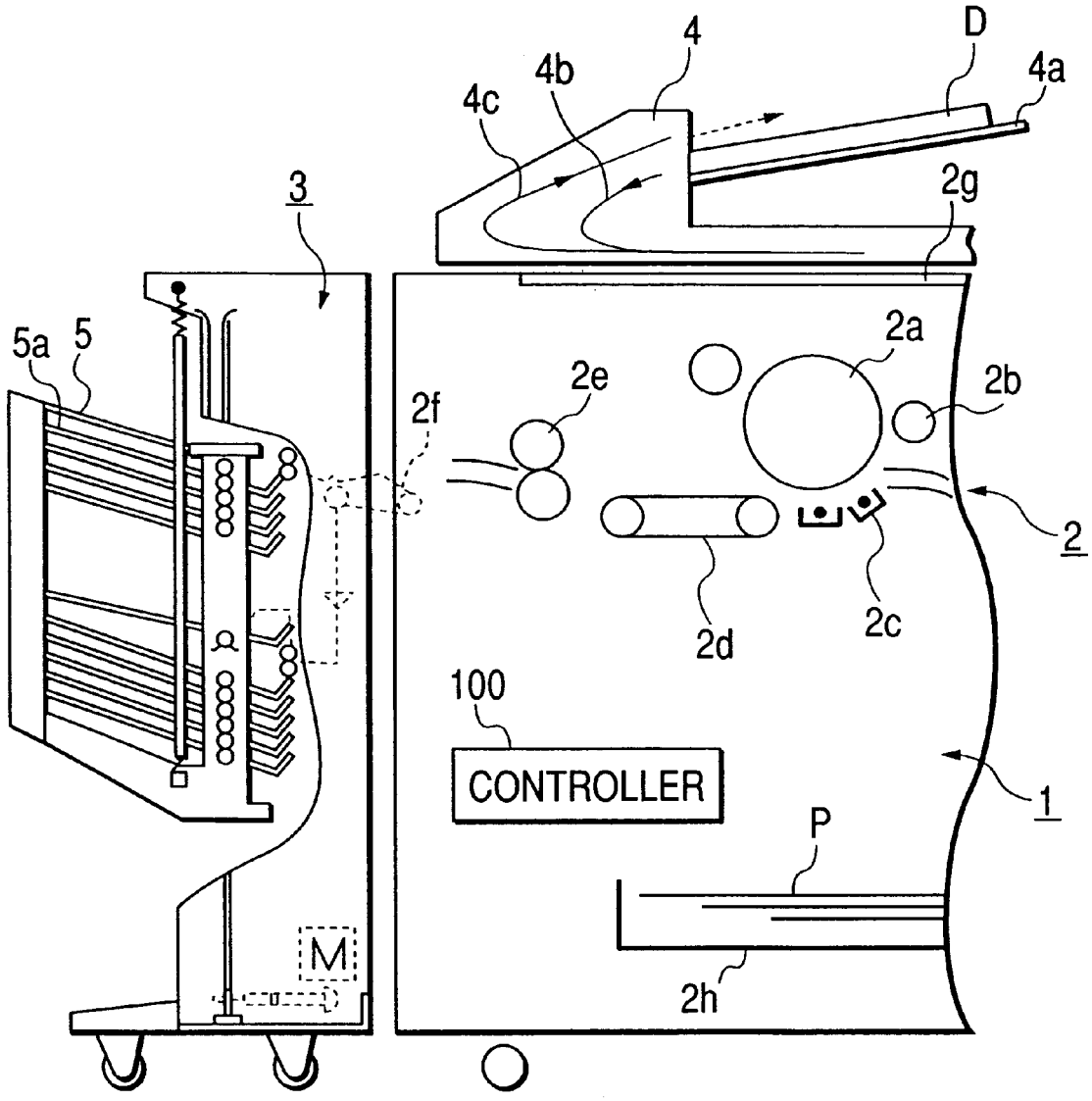
FIG. 1 is a partial elevational sectional view of an image forming apparatus having a sheet processing apparatus according to the present invention.

First of all, a schematic construction of an image forming apparatus will be described with reference to FIG. 1. The image forming apparatus 1 is provided at its upper part with an image forming portion (image forming means) 2, and an automatic original feeding device 4 for automatically circulating originals (documents) D is disposed on an upper surface of the image forming apparatus. A sheet processing apparatus (referred to as "sorter" hereinafter) 3 having a plurality of bin trays 5*a* is disposed adjacent to a side (left in FIG. 1) surface of the image forming apparatus. Sheets P in a cassette 2*h* are supplied one by one to the image forming portion 2 by means of a sheet supply means (not shown).

The image forming portion 2 is well-known electrophotographic type (not fully described) in which an image of the original D positioned on a platen glass 2*g* is formed on a photosensitive drum 2*a* as a latent image by means of an optical system (not shown) and the latent image is visualized (as a toner image) by a developing device 2*b* disposed around the photosensitive drum 2*a*. The toner image is transferred onto the sheet P by a transfer device 2*c*, and, after the sheet is separated from the photosensitive drum 2*a* by a convey belt 2*d*, the sheet is sent to a fixing device 2*e*, where the toner image is permanently fixed to the sheet P. Thereafter, the sheet P is discharged to a downstream sorter 3 by a pair of discharge rollers (discharge means) 2*f*.

<Original Feeding Device>

The automatic original feeding device 4 serves to send a lowermost original among an original bundle D rested on an original stacking plate 4*a* onto the platen glass 2*g* through a sheet supply path 4*b* and to return the original which was read onto the original bundle D again via a discharge path 4*c*.

<Sheet Processing Apparatus>

Figure 2:
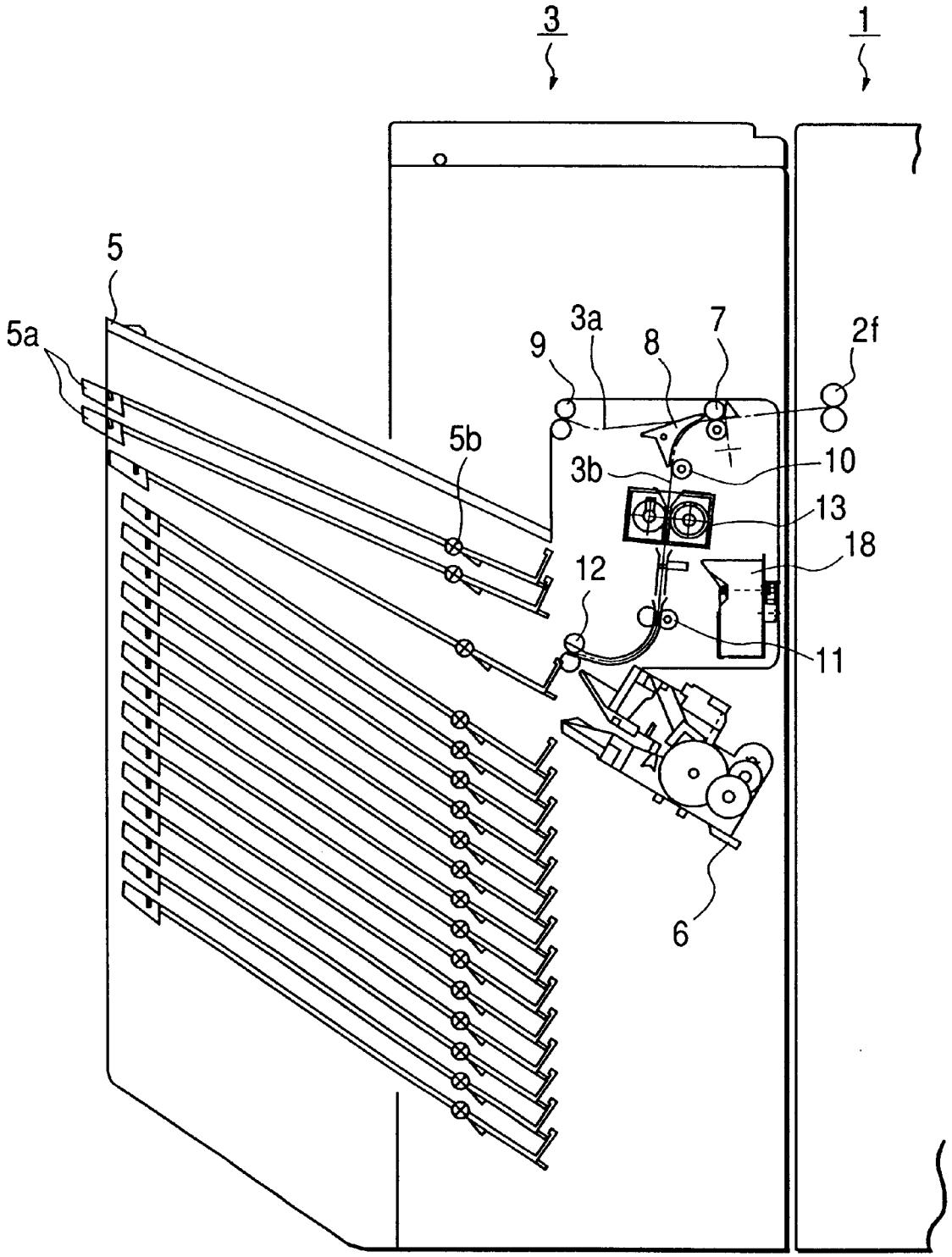
FIG. 2 is an elevational sectional view of the sheet processing apparatus according to the present invention.

As shown in FIG. 2, the sorter (sheet processing apparatus) 3 is of the so called bin moving type and comprises a plurality of bin trays 5*a* housed in a bin unit 5 and adapted to stack and contain the sheets P. The bin trays 5*a* laminated in a vertical direction can be lifted and lowered independently by lifting and lowering associated subrollers 5*b* arranged on both side of the bin trays 5*a*.

The sheet P discharged from the image forming apparatus 1 to the sorter 3 is conveyed by inlet rollers 7 and is branched by a flapper 8 to be selectively sent to a non-sort path 3*a* through which the sheet is directly discharged or a sort path 3*b* through which the sheet is subjected to a sorting operation and a perforating operation. When the sheet P is merely discharged, the sheet P is discharged out of the apparatus through the nonsort path 3*a* by means of discharge rollers 9.

The sheet P sent to the sort path 3*b* is conveyed by a first intermediate roller 10 and is passed through a puncher 13 where the sheet is perforated. Then, the sheet is conveyed by a second intermediate roller 11 and sort discharge rollers 12 to be discharged into the bin unit 5. In this case, the sheet P is sorted by lifting or lowering the bin trays 5*a* in synchronism with sheet conveyance. If necessary, the sheets P stacked on the bin tray(s) 5*a* may be stapled by a staple unit 6.

<Puncher>

Figure 3:
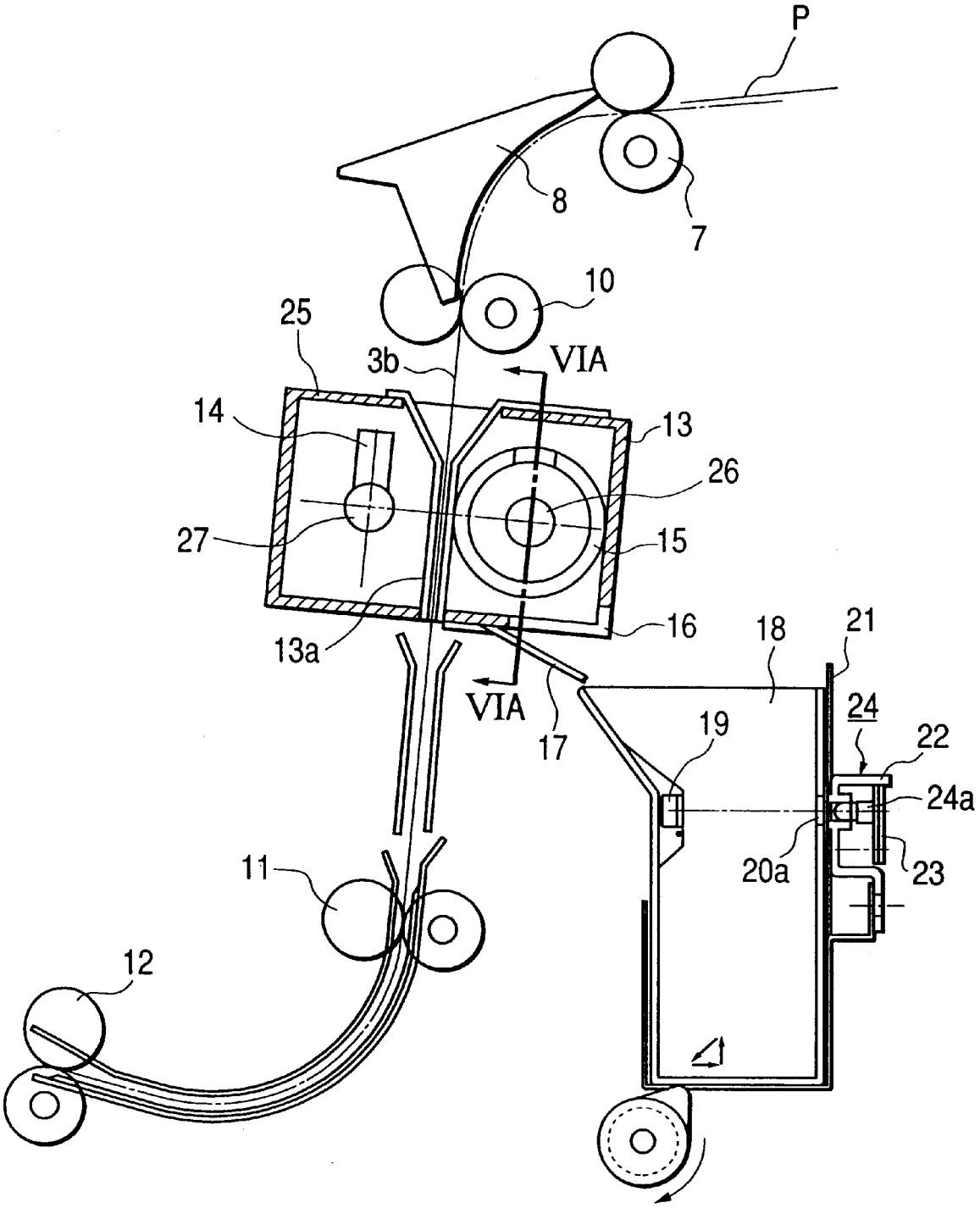
FIG. 3 is an elevational sectional view of a puncher portion of the sheet processing apparatus according to the present invention.

FIG. 3 is an enlarged view of the puncher 13 and therearound.

In the puncher 13, a sheet guide 13*a* (as a convey path) is formed within a puncher frame 25 at a central thereof, and a punch 14 and a die 15 are disposed on both sides of the sheet guide 13*a*. In the case of a puncher for forming two perforations along a widthwise direction of the sheet P, there are two punches 14 and two dies 15; whereas, in case of a puncher for forming three perforations along the widthwise direction of the sheet, there are three punches 14 and three dies 15, so that a predetermined number of (i.e., plurality of) perforations can be formed in the sheet P at once.

The punches 14 and the dies 15 are rotated at peripheral speeds equal to a conveying speed of the sheet P in a synchronous manner, thereby forming the perforations in a tail end portion of the sheet P at predetermined locations thereon. After the perforating, the punches 14 and the dies 15 are rotated through one revolution and then are stopped at initial positions for preparation for a next sheet P.

A dust dropping hole 16 and a slope plate 17 are disposed below the die 15 of the puncher 13, through which punched pieces PW produced by the perforating operation can be dropped. Further, a punch dust containing box 18 is disposed below the die 15 of the puncher 13. As shown in FIG. 5, the punch dust containing box 18 is provided at its one end with a grip 18*a*. The punch dust containing box 18 is detachably mounted to a dust box stay 21, as shown in FIG. 3, and is locked at a predetermined position by an elastic member (not shown). A reflection plate 19 is attached to an inner surface of the punch dust containing box 18 and two detection holes 20*a*, 20*b* (FIG. 4) are formed in an inner surface opposed to the reflection plate 19.

Further, a sensor (detection means) 24 for detecting the punched pieces PW contained in the punch dust containing box 18 is attached to the dust box stay 21. The sensor 24 comprises a sensor holder 22 secured to the dust box stay 21, a base plate 23 supported by the sensor holder 22, and light emitting and receiving elements 24*a*, 24*b* attached to the base plate 23. The light emitting element 24*a* and the light receiving element 24*b* are arranged in a confronting relation to the detection holes 20*a*, 20*b*, and the reflection plate 19 is opposed to the light emitting element 24*a* and the light receiving element 24*b* with the interposition of a containing portion of the punch dust containing box 18.

Figure 4:
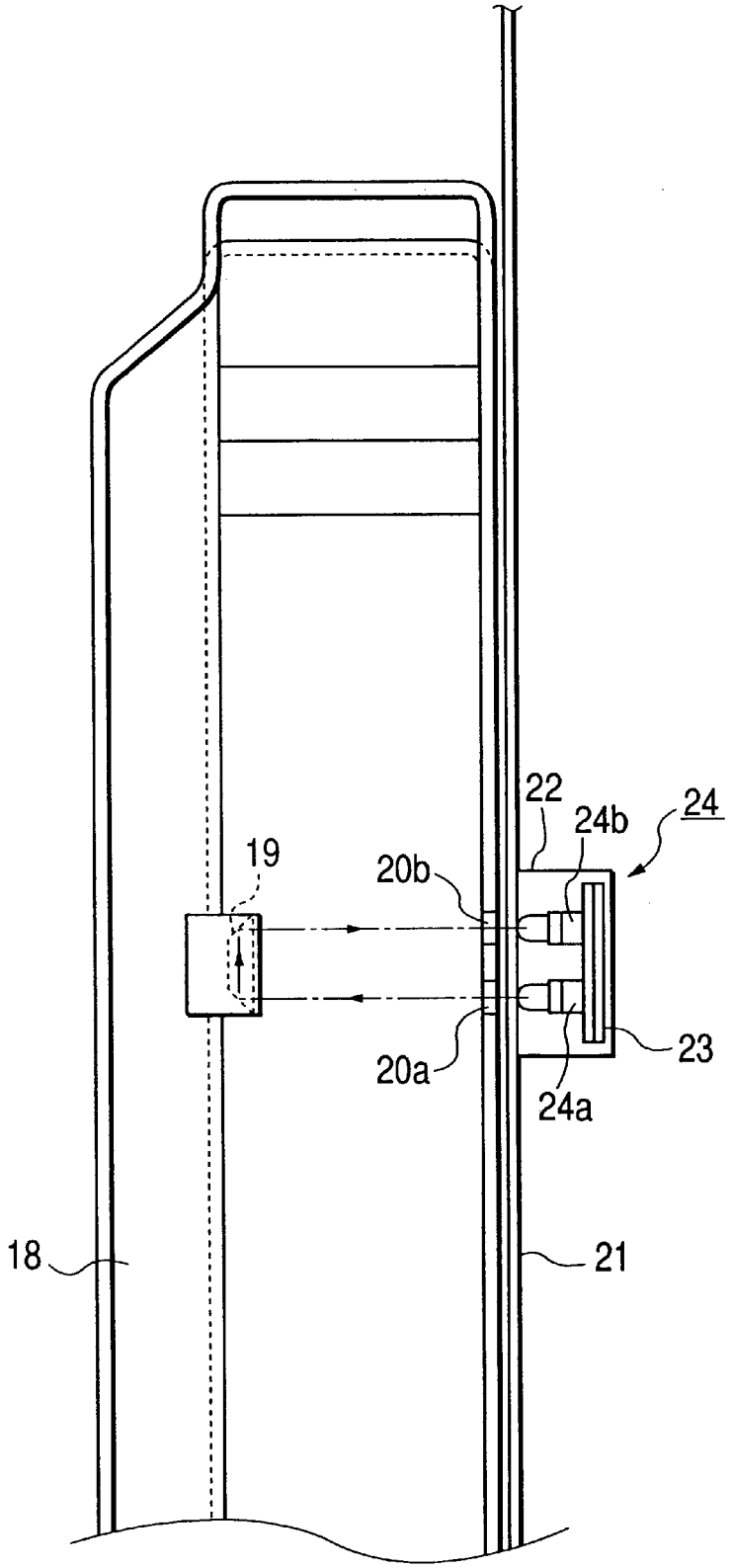
FIG. 4 is a plan view of a punch dust containing box.
Figure 5:
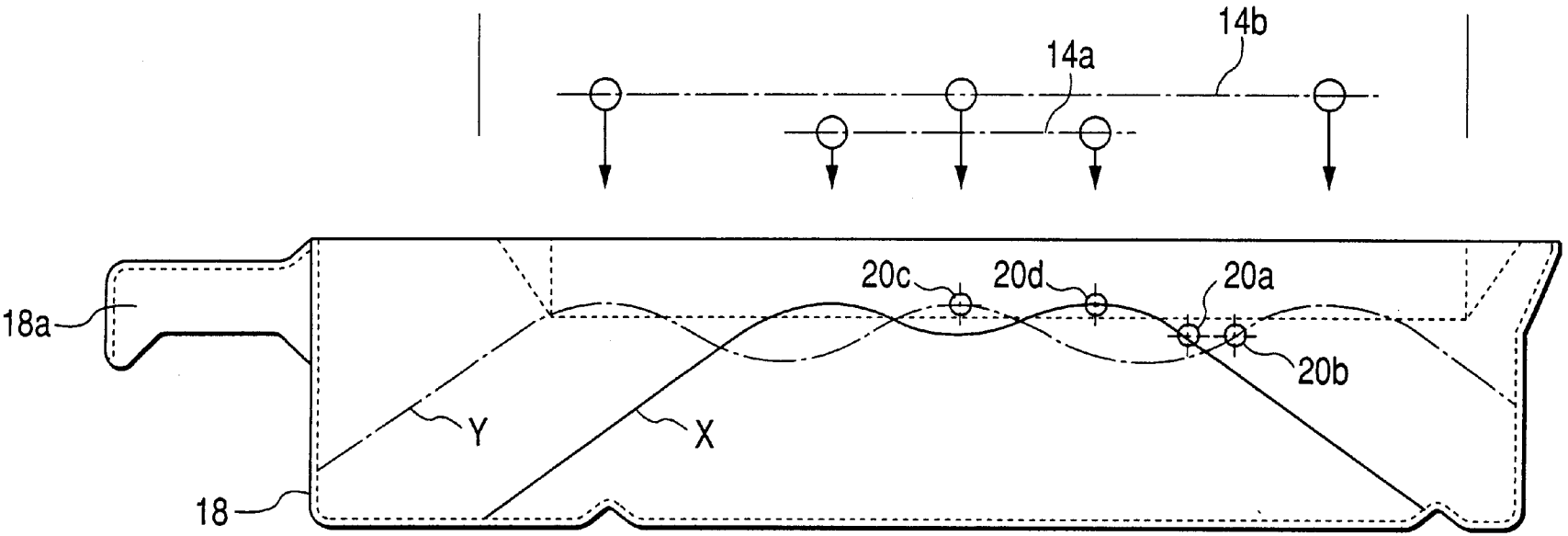
FIG. 5 is a side view of the punch dust containing box.

As shown in FIG. 4, light emitted from the light emitting element 24*a* passes through the detection hole 20*a* and is reflected by the reflection plate 19 at a right angle twice. Then, the light passes through the detection hole 20*b* and is received by the light receiving element 24*b* for detection. Accordingly, if the punch dust containing box 18 is not correctly attached to the dust box stay 21, the light receiving element 24*b* cannot detect the light from the light emitting element 24*a*.

FIG. 5 shows an arrangement of the punch 14 and the detection holes 20*a*, 20*b*. For example, when the sheet P is perforated by the puncher for forming two perforations, the punches 14 and dies 15 are disposed at two-perforation positions 14*a* shown in FIG. 5; whereas, when the sheet P is perforated by the puncher for forming three perforations, the punches 14 and dies 15 are disposed at three-perforation positions 14*b*. In this case, the punched pieces PW produced by the two-perforation forming puncher are accumulated to form a two-peak dust mountain X (shown by the continuous line) within the containing portion of the punch dust containing box 18; whereas, the punched pieces produced by the three-perforation forming puncher are accumulated to form a three-peak dust mountain Y shown by the dot and dash line. In FIG. 5, the two-peak dust mountain X and the tree-peak dust mountain Y show conditions that the dust box is filled with the punched pieces, respectively.

The detection holes 20*a*, 20*b* are disposed in the vicinity of the intersection between the two-peak dust mountain X and the three-peak dust mountain Y so that the detection hole 20*a* can overlap with the slope surface of the two-peak dust mountain X and the detection hole 20*b* can overlap with the slope surface of the three-peak dust mountain Y. Accordingly, when the sheet P is perforated by the two-perforation forming puncher or the three-perforation forming puncher, if the punch dust containing box is filled with the punched pieces PW, the light from the light emitting element 24*a* is blocked by the dust mountain, with the result that the light is not detected by the light receiving element 24*b*.

Thus, the fact that the light emitted from the light emitting element 24*a* reaches the light receiving element 24*b* informs the operator of the fact that the punch dust containing box 18 is installed at the proper position and the amount of the punched pieces PW does not reach a predetermined amount. Conversely, if the light receiving element 24*b* did not detect the light, the punch dust containing box will be filled with the punched pieces PW or the punch dust containing box 18 will not be installed at the proper position.

Figure 6A:
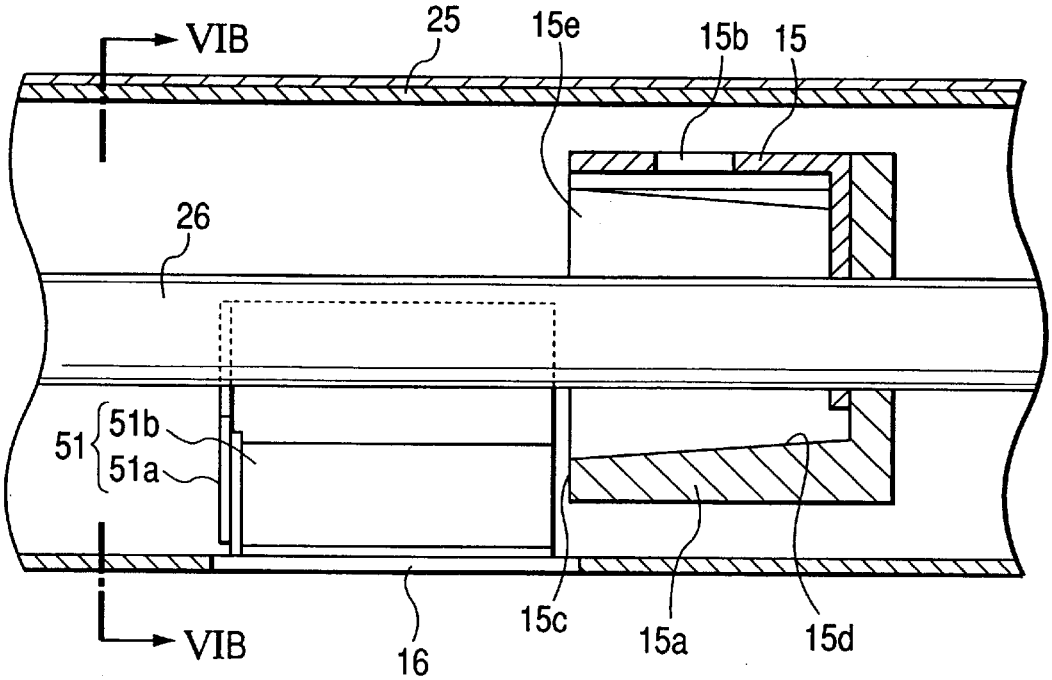
FIG. 6A is a front sectional view of a die portion of the puncher, taken along the line VIA—VIA in FIG. 3.
Figure 6B:
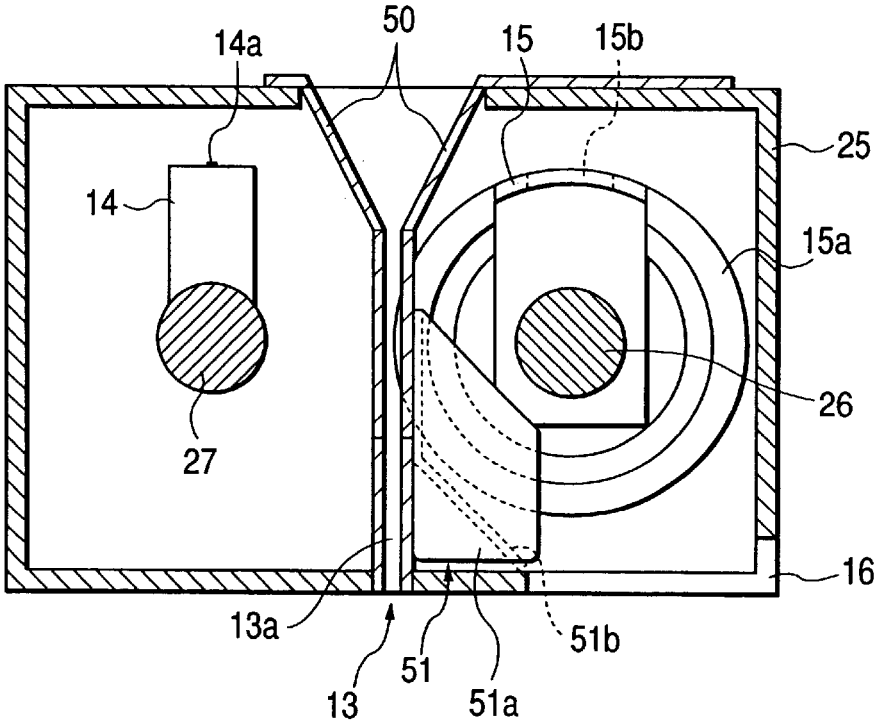
FIG. 6B is a sectional view taken along the line VIB—VIB in FIG. 6A.

Next, the puncher 13 according to the present invention will be fully described with reference to FIGS. 6A and 6B.

Each die 15 is secured to a die cover 15*a* secured to a rotatable support shaft 26 and having an opening portion 15*e* at its one end and has a die hole 15*b*. Each punch 14 has a proximal end secured to a rotatable support shaft 27. A pair of guide plates 50 for forming the sheet guide 13*a* (for guiding the sheet P) are disposed between the punch 14 and the die 15. The guide plates 50 are partially cut away not to interfere with rotations of the punch 14 and the die 15.

A dust guide member (dust guide means) 51 for guiding the punched pieces PW discharged from the die cover 15*a* toward the dust dropping hole 16 is disposed in the vicinity of the dust dropping hole 16.

The dust guide member 51 comprises a partition plate 51*a*, and an inclined plate 51*b*. When looked at from a lateral direction, the inclined plate 51*b* is inclined so that one end of the inclined plate 51*b* is located in the vicinity of an edge 15*c* of the opening portion 15*e* of the die cover 15*a* and a lower end of the inclined plate 51*b* is located at the dust dropping hole 16. The partition plate 51*a* is uprightly protruded from the end of the inclined plate 51*b* remote from the die cover 15*a* and serves to catch the punched pieces PW thrown (discharged) from the die cover 15*a* and to direct the punched pieces PW toward the inclined plate 51*b*.

The inner peripheral surface of the die cover 15*a* is disposed inwardly of the inclined plate 51*b* of the dust guide member 51, i.e., above an inclined surface of the inclined plate 51*b*, so that all of the punched pieces PW from the die cover 15*a* are discharged onto the inclined plate 51*b*.

The inner peripheral surface of the die cover 15*a* has a taper 15*d* having a diameter increasing toward the opening portion 15*e*. Due to the presence of such taper 15*d*, the punched pieces PW trapped in the die cover 15*a* are apt to be discharged toward the opening portion 15*e* (toward the left in FIG. 6A).

The die cover 15*a* is formed from antistatic material (having insulation resistance of about $10^{12}\Omega$) having good sliding ability for the punched pieces PW, whereby the punched pieces PW are prevented from being adhered to the die cover 15*a*. The antistatic material for the die cover 15*a* may have insulation resistance of about $10^{5}$ to $10^{12}\Omega$.

As mentioned above, by providing the dust guide member 51 in the vicinity of the opening portion 15*e* of the die cover 15*a*, the punched pieces PW thrown from the die cover 15*a* are guided to the dust dropping hole 16, thereby preventing the punched pieces from being accumulated within the puncher frame 25.

Next, a configuration of the punch 14 will be described with reference to FIGS. 7A, 7B and 7C. A boss 14*a* (having a height of 0.2 mm) is provided on a tip end surface of the punch 14, and the boss 14*a* serves to push the new punched pieces PW (immediately after the punching operation) into the die hole 15*b* (FIG. 6A), as shown in FIG. 7B.

Figure 7A:
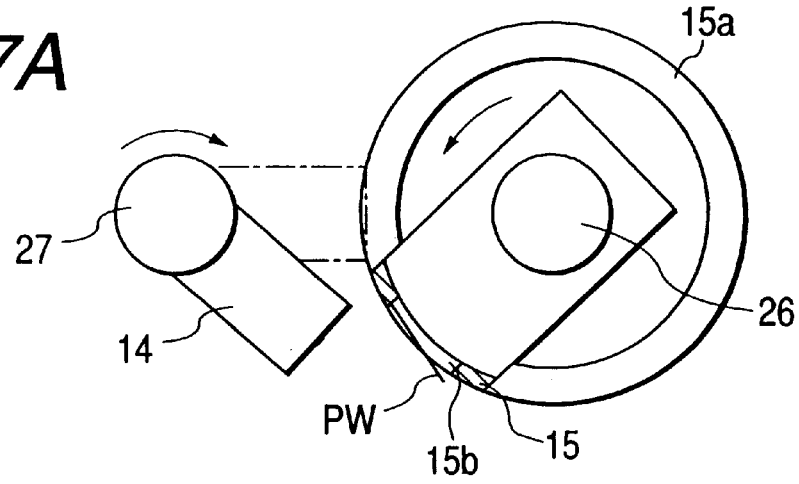
FIG. 7A is a view for explaining a punching operation of a punch having no boss.
Figure 7B:
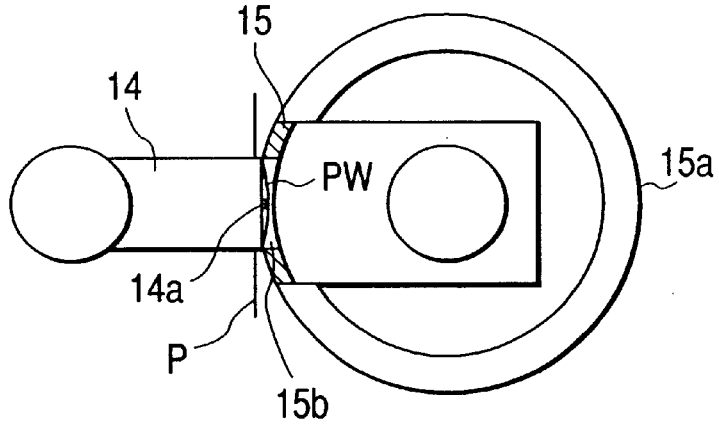
FIG. 7B is a view for explaining a punching operation of a punch having a boss.
Figure 7C:
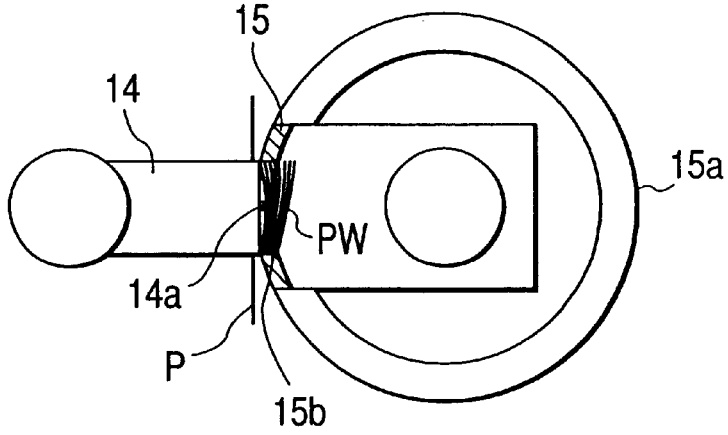
FIG. 7C is a view showing a condition that the punching operation of FIG. 7B are repeated.

FIG. 7A shows a case where the punch 14 has no boss 14*a*. In this case, as the die 15 is rotated, the new punched pieces PW may be thrown out of the die hole 15*b* to be scattered into the sheet guide 13*a*. In the case of the boss 14*a* having the height of about 0.2 mm, as shown in FIG. 7B, the boss 14*a* pushes the punched pieces PW into the die, thereby preventing the punched pieces PW from scattering.

If the height of the boss 14*a* of the punch 14 is selected to a value greater than 0.4 mm, since the punched pieces PW are punched (formed) while being curved, diameters of the punched pieces become considerably greater than a diameter of the die hole 15*b*, with the result that the punched pieces PW are packed in the die hole 15*b* (particularly, one ends of the punched pieces are strongly urged against the inner surface of the die hole), thereby the punched pieces PW are not strewn but become a mass of the punched pieces to cause a problem of piles of the punched pieces in the die cover 15*a*.

Accordingly, the height of the boss 14*a* of the punch 14 is preferably 0.1 to 0.3 mm, and, in the illustrated embodiment, the height of the boss is selected to 0.2 mm.

Next, the characteristic operation of the sheet processing apparatus according to the present invention will be explained.

Figure 8A:
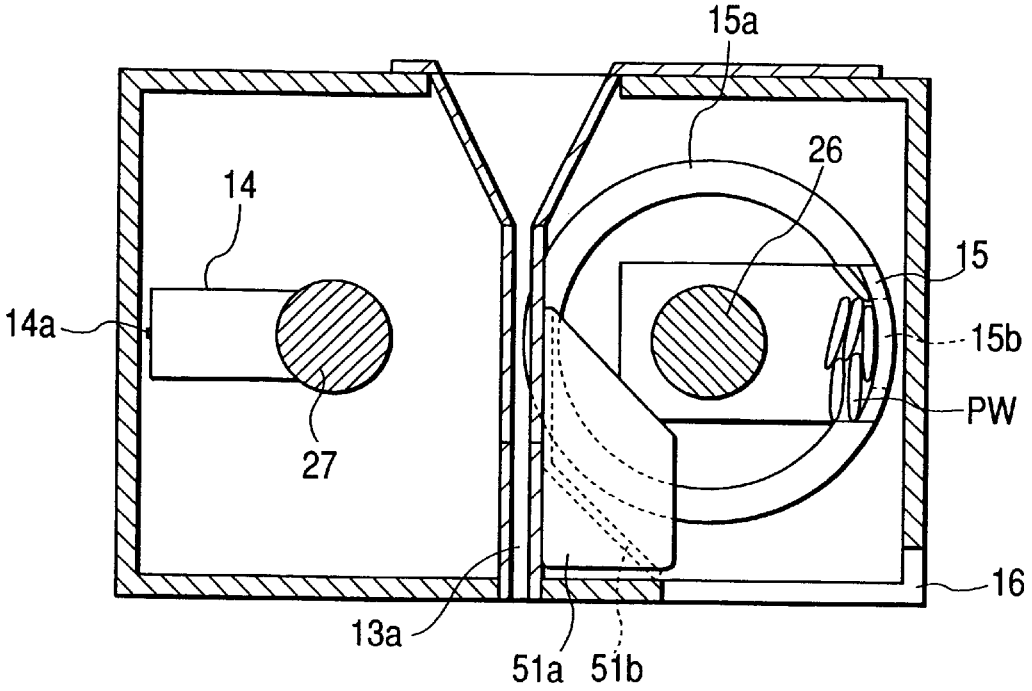
FIG. 8A is a view showing home positions of the punch and die.

FIG. 8A shows a condition that the punch 14 and the die 15 are returned to their home positions after the punch job was finished. After the continuous jobs, some of the punched pieces PW may be trapped within the die 15 and the die cover 15*a* due to the centrifugal force acting on the die 15 and the die cover 15*a*.

Figure 8B:
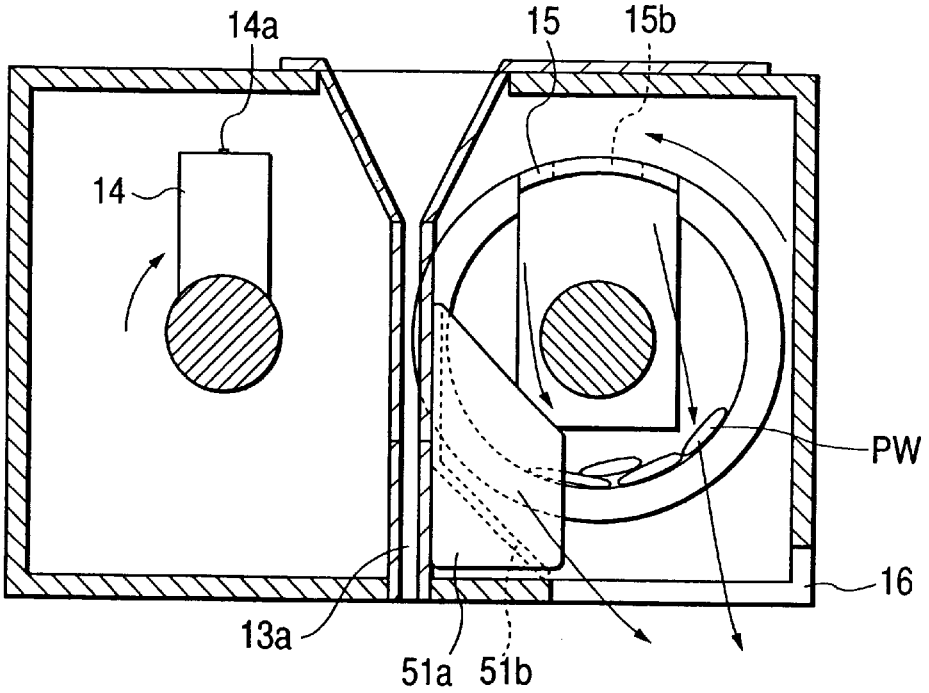
FIG. 8B is a view showing a condition that punched pieces are dropped by normal/reverse rotations of the punch and die.

Thus, after the punch job is finished, the punch 14 and the die 15 are rotated at a low speed (60 rpm) through a predetermined angle (for example, about 90 degrees) by a controller 100 (FIG. 1) to assume a condition shown in FIG. 8B, so that the punched pieces PW are dropped downwardly within the die cover 15*a*. Thereafter, the die 15 is rotated in a reverse direction through a predetermined angle (about 90 degrees) to return it to the home position.

The dropped punched pieces PW are discharged to the dust guide member 51 by the action of the taper 15*d* of the die 15 and are collected into the punch dust containing box 18 via the inclined plate 51*b* and the dust dropping hole 16.

Further, in the illustrated embodiment, also immediately before the punch job, the normal and reverse rotations of the punch 14 and the die 15 are effected. Such rotations are not limited to the above-mentioned timing but may be effected during the waiting condition of the punch job.

Such rotations of the punch 14 and the die 15 can prevent the inconvenience in which the punched pieces PW partially trapped in the die cover 15*a* remain for a long time to be gathered together due to the influence of the temperature thereby to adhere the punched pieces to the die cover 15*a*.

Figure 9A:
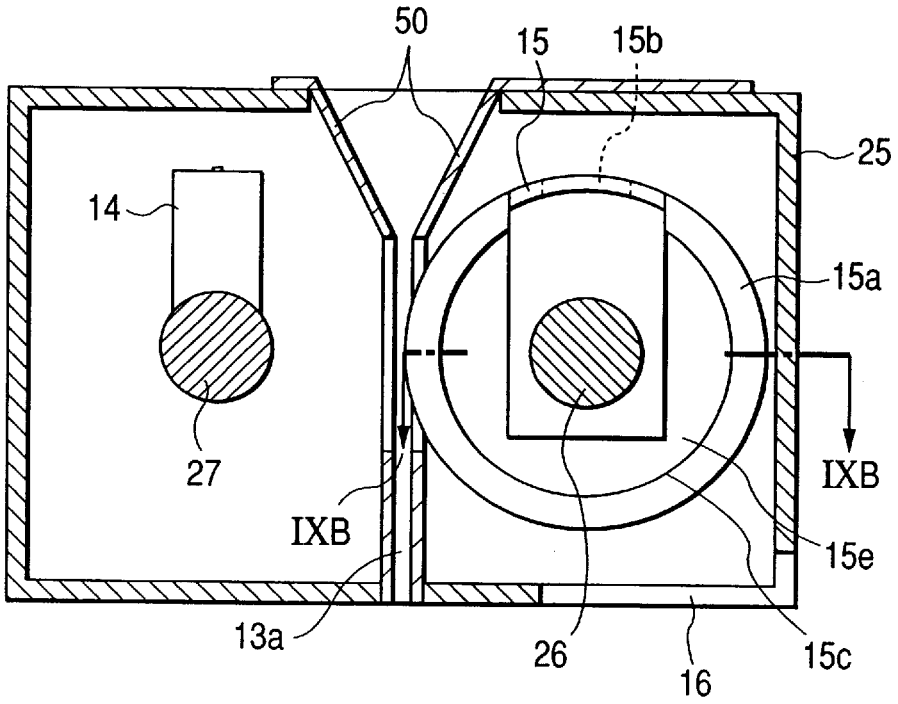
FIG. 9A is a view showing a positional relation between a die cover and a guide plate of a sheet guide.
Figure 9B:
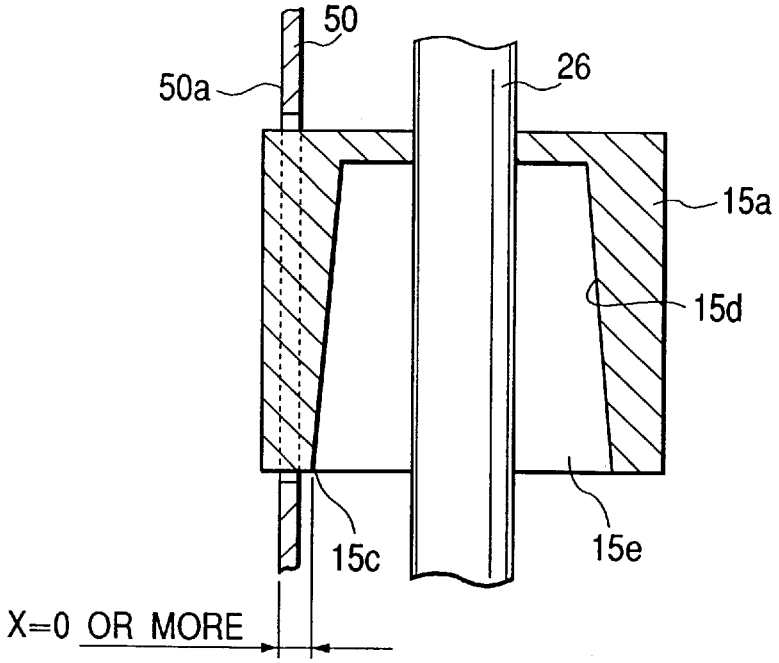
FIG. 9B is a sectional view taken along the line IXB—IXB in FIG. 9A.
Figure 10A:
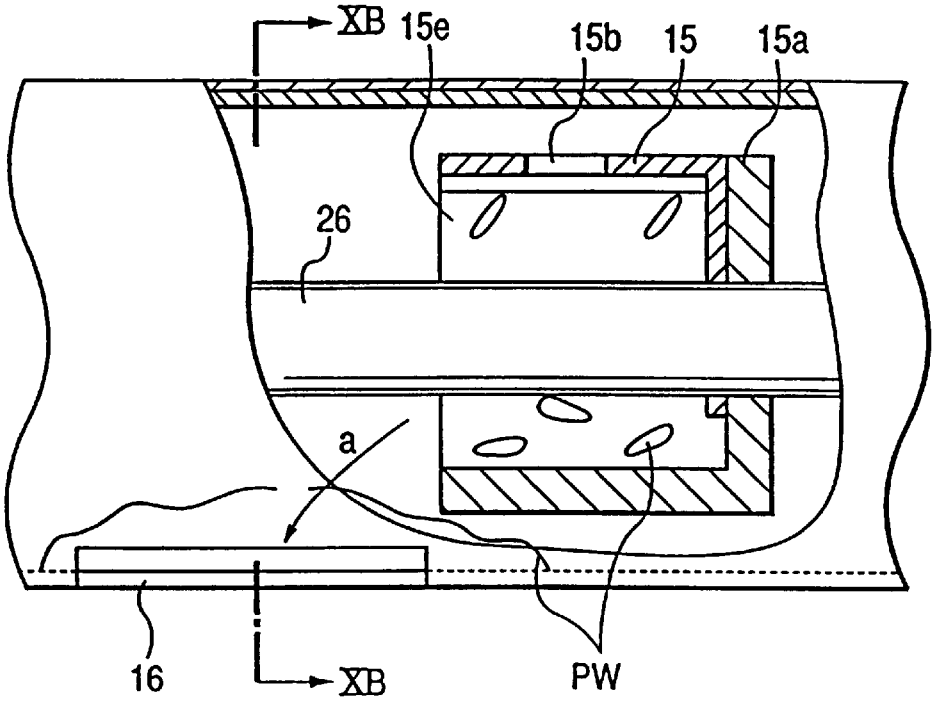
FIG. 10A PRIOR ART
FIG. 10A is a partial front sectional view of a die portion of a conventional puncher.
Figure 10B:
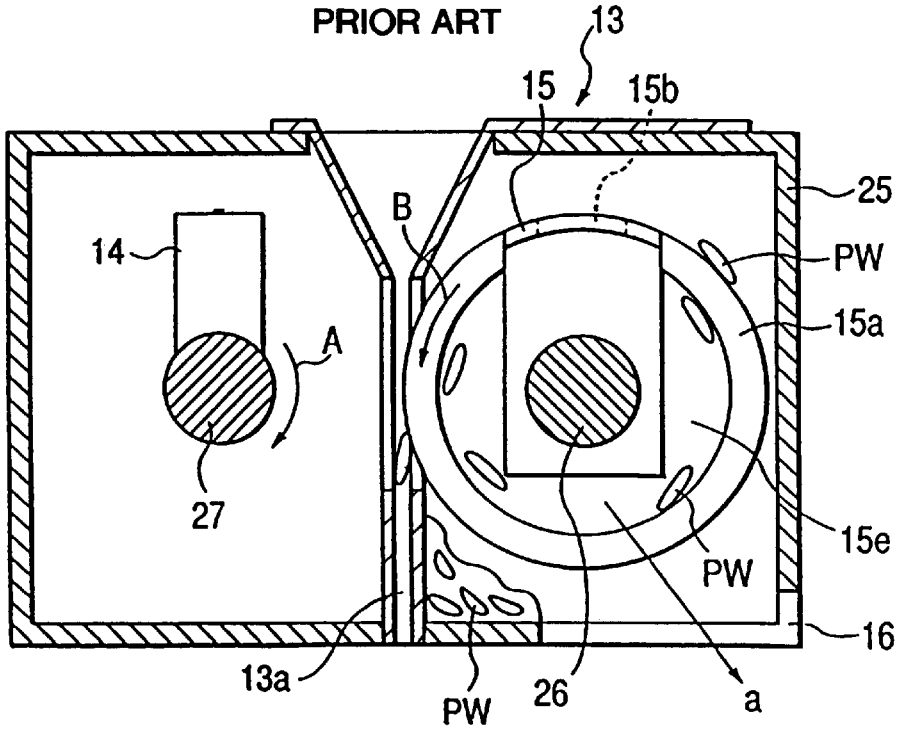
FIG. 10B PRIOR ART
FIG. 10B is a sectional view taken along the line XB—XB in FIG. 10A.

FIGS. 9A and 9B show a positional relation between the edge 15*c* of the opening portion 15*e* of the die cover 15*a* and the sheet guide 13*a* of the puncher frame 25. As shown in FIGS. 9A and 9B, although a part of the outer peripheral surface of the die cover 15*a* may extend from the guide plate 50 constituting the sheet guide 13*a*, the edge 15*c* (outer end of the inner peripheral surface) of the die cover 15*a* is disposed nearer the die cover 15*a* than an inner surface 50*a* of the guide plate 50, so that a distance X between the inner surface 50*a* of the guide plate 50 and the edge 15*c* of the opening portion 15*e* of the die cover 15*a* becomes greater than zero (0). With this arrangement, the punched pieces PW in the die cover 15*a* are always discharged within the puncher frame 25, thereby preventing the punched pieces PW from entering into the sheet guide 13*a*.

As mentioned above, according to the present invention, since the dust guide means is disposed in the vicinity of the opening portion of the die cover within the puncher frame constituting the puncher, the punched pieces discharged from the die cover are surely guided to the dust dropping hole by the dust guide means to be discharged out of the puncher frame, thereby preventing the punched pieces from being accumulated within the puncher frame. Since the punched pieces can be discharged from the puncher frame without inclining the puncher frame, the puncher can be installed horizontally, thereby increasing freedom of degree of design.

Further, since the die cover is formed from antistaic material, the punched pieces can be prevented from adhering to the inner and outer peripheral surfaces of the die cover, thereby preventing the punched pieces from being accumulated within the die cover and from being scattered into the sheet guide.

Further, since the boss for pushing the punched pieces is provided on the tip end surface of the punch, the punched pieces can be prevented from being scattered within the die hole and being trapped, jammed or aggregated in the die hole.

What is claimed is:

1. A sheet processing apparatus comprising:

a sheet convey path through which a sheet is conveyed;

a punch and a die for perforating the sheet being conveyed through said sheet convey path;

a cylindrical die cover having an opening at its one end and integrally formed with said die and formed from antistatic material; and a dust dropping hole through which punched pieces discharged from said opening of said die cover are dropped.

2. A sheet processing apparatus according to claim 1, wherein an inner peripheral surface of said die cover is provided with a taper oriented to increase said opening.

3. A sheet processing apparatus according to claim 1 or 2, wherein said punch is provided at its tip end surface with a boss having a height of 0.1 mm to 0.3 mm.

4. A sheet processing apparatus according to claim 1 or 2, further comprising a control means for controlling said punch and said die in such a manner that, after a punch job is finished or immediately before a punch job is started, said punch and said die are rotated at a predetermined speed through a predetermined angle and then are rotated in a reverse direction through a predetermined angle.

5. A sheet processing apparatus according to claim 1, further comprising a dust guide member for directing the punched pieces discharged from said opening of said die cover toward said dust dropping hole.

6. A sheet processing apparatus according to claim 5, wherein said dust guide member comprises an inclined member having an upper end disposed at said opening of said die cover and a lower end disposed at said dust dropping hole, and a partition plate provided on an end of said inclined member remote from said opening of said die cover.

7. A sheet processing apparatus comprising:

a sheet convey path through which a sheet is conveyed;

a rotatable punch forming a part of a puncher for perforating the sheet being conveyed through said sheet convey path;

a rotatable die cooperating with said punch and forming a part of said puncher for perforating the sheet, said die having a cylindrical die cover formed from antistatic material and provided at its one end with an opening; and a puncher frame for containing said punch and said die, said puncher frame having a sheet guide to pass the sheet and being disposed between said punch and said die and further having a dust dropping hole through which punched pieces produced by the perforating of the sheet are dropped.

8. A sheet processing apparatus according to claim 7, wherein an inner peripheral surface of said die cover is provided with a taper oriented to increase said opening.

9. A sheet processing apparatus according to claim 7 or 8, wherein said punch is provided at its tip end surface with a boss having a height of 0.1 mm to 0.3 mm.

10. A sheet processing apparatus according to claim 7 or 8, further comprising a control means for controlling said punch and said die in such a manner that, after a punch job is finished or immediately before a punch job is started, said punch and said die are rotated at a predetermined speed through a predetermined angle and then are rotated in a reverse direction through a predetermined angle.

11. A sheet processing apparatus according to claim 7, further comprising a dust guide member for directing the punched pieces discharged from said opening of said die cover toward said dust dropping hole.

12. A sheet processing apparatus according to claim 11, wherein said dust guide member comprises an inclined member having an upper end disposed at said opening of said die cover and a lower end disposed at said dust dropping hole, and a partition plate provided on an end of said inclined member remote from said opening of said die cover.

13. An image forming apparatus comprising:

an image forming means for forming an image on a sheet being conveyed; and a sheet processing apparatus, said sheet processing apparatus including:

a sheet conveyance path through which a sheet is conveyed;

a punch and a die for perforating the sheet being conveyed through said sheet conveyance path;

a cylindrical die cover having an opening at its one end and integrally formed with said die and formed from antistatic material; and a dust dropping hole through which punched pieces discharged from said opening of said die cover are dropped, wherein the sheet on which the image was formed by said image forming means is perforated and discharged by the sheet processing apparatus.

14. An image forming apparatus according to claim 13, wherein an inner peripheral surface of said die cover is provided with a taper oriented to increase said opening.

15. An image forming apparatus comprising:

an image forming means for forming an image on a sheet being conveyed; and a sheet processing apparatus, said sheet processing apparatus including:

a sheet conveyance path through which a sheet is conveyed;

rotatable punch forming a part of a puncher for perforating the sheet being conveyed through said sheet conveyance path;

a rotatable die cooperating with said punch and forming a part of said puncher for perforating the sheet, said die having a cylindrical die cover formed from antistatic material and provided at its one end with an opening; and a puncher frame for containing said punch and said die, said puncher frame having a sheet guide to contain the sheet and disposed between said punch and said die and further having a dust dropping hole through which punched pieces produced by the perforating of the sheet are dropped, wherein the sheet on which the image was formed by said image forming means is perforated and discharged by the sheet processing apparatus.

16. An image forming apparatus in accordance with claim 15, wherein an inner peripheral surface of said die cover is provided with taper oriented to increase said opening.

17. A sheet processing apparatus comprising:

a sheet convey path through which a sheet is conveyed;

a punch and a die for perforating the sheet being conveyed through said sheet convey path;

a cylindrical die cover having an opening at its one end and integrally formed with said die and formed from antistatic material;

a dust dropping hole through which punched pieces discharged from said opening of said die cover are dropped; and a dust guide member for directing the punched pieces discharged from said opening of said die cover toward said dust dropping hole, wherein an inner peripheral surface of said die cover is provided with a taper oriented to increase said opening.

18. A sheet processing apparatus comprising:

a sheet convey path through which a sheet is conveyed;

a punch and a die for perforating the sheet being conveyed through said sheet convey path;

a cylindrical die cover having an opening at its one end and integrally formed with said die and formed from antistatic material;

a dust dropping hole through which punched pieces discharged from said opening of said die cover are dropped; and a dust guide member for directing the punched pieces discharged from said opening of said die cover toward said dust dropping hole, wherein an inner peripheral surface of said die cover is provided with a taper oriented to increase said opening, and wherein said dust guide member includes an inclined member having an upper end disposed at said opening of said die cover and a lower end disposed at said dust dropping hole, and a partition plate provided on an end of said inclined member remote from said opening of said die cover.

19. A sheet processing apparatus comprising:

a sheet convey path through which a sheet is conveyed;

a rotatable punch forming a part of a puncher for perforating the sheet being conveyed through said sheet convey path;

a rotatable die cooperating with said punch and forming a part of said puncher for perforating the sheet, said die having a cylindrical die cover formed from antistatic material and provided at its one end with an opening;

a puncher frame for containing said punch and said die, said puncher frame having a sheet guide to pass the sheet and being disposed between said punch and said die and further having a dust dropping hole through which punched pieces produced by perforating of the sheet are dropped; and a dust guide member for directing the punched pieces discharged from said opening of said die cover toward said dust dropping hole, wherein an inner peripheral surface of said die cover is provided with a taper oriented to increase said opening.

20. A sheet processing apparatus comprising:

a sheet convey path through which a sheet is conveyed;

a rotatable punch forming a part of a puncher for perforating the sheet being conveyed through said sheet convey path;

a rotatable die cooperating with said punch and forming a part of said puncher for perforating the sheet, said die having a cylindrical die cover formed from antistatic material and provided at its one end with an opening;

a puncher frame for containing said punch and said die, said puncher frame having a sheet guide to pass the sheet and being disposed between said punch and said die and further having a dust dropping hole through which punched pieces produced by perforating of the sheet are dropped; and a dust guide member for directing the punched pieces discharged from said opening of said die cover toward said dust dropping hole, wherein an inner peripheral surface of said die cover is provided with a taper oriented to increase said opening, and wherein said dust guide member includes an inclined member having an upper end disposed at said opening of said die cover and a lower end disposed at said dust dropping hole, and a partition plate provided on an end of said inclined member remote from said opening of said die cover.

* * * * *

UNITED STATES PATENT AND TRADEMARK OFFICE

CERTIFICATE OF CORRECTION

PATENT NO. : 6,253,057 B1
DATED : June 26, 2001
INVENTOR(S) : Yuji Yamanaka

It is certified that error appears in the above-identified patent and that said Letters Patent is hereby corrected as shown below:

Column 3,
Line 28, "are" should read -- is --.
Line 44, "be now" should read -- now be --.

Column 4,
Line 20, "side" should read -- sides --.
Line 23, "non-sort" should read -- nonsort --.
Line 42, "a central (thereof," should read -- a central position thereof --.

Column 5,
Line 40, "tree-peak" should read -- three-peak --.

Column 6,
Line 64, "thereby" should read -- whereby --.

Column 7,
Line 66, "antistaic" should read -- antistatic --.

Column 9,
Line 51, "rotatable" should read -- a rotatable --.

Signed and Sealed this

Thirtieth Day of April, 2002

*Attest:*

*Attesting Officer*

JAMES E. ROGAN
*Director of the United States Patent and Trademark Office*